US006077025A

United States Patent [19]

Budd et al.

[11] Patent Number: 6,077,025

[45] Date of Patent: Jun. 20, 2000

[54] PIVOTING SAFETY BARRIER FOR WHEELCHAIR LIFT

[75] Inventors: Alfred L. Budd, Winamac; Jeffery J. Hermanson, Culver, both of Ind.

[73] Assignee: The Braun Corporation, Winamac, Ind.

[21] Appl. No.: 09/373,100

[22] Filed: Aug. 12, 1999

Related U.S. Application Data

[60] Provisional application No. 60/096,539, Aug. 13, 1998.

[51] Int. Cl.[7] ..... B60P 1/44

[52] U.S. Cl. ..... 414/546; 414/921

[58] Field of Search ..... 414/546, 921, 414/540

[56] References Cited

U.S. PATENT DOCUMENTS

| | | | |
|---|---|---|---|
| 4,260,320 | 4/1981 | Steiger | 414/680 |
| 4,804,308 | 2/1989 | Hamblin et al. | 414/540 |
| 5,261,779 | 11/1993 | Goodrich et al. | 414/546 |

*Primary Examiner*—Steven A. Bratlie

*Attorney, Agent, or Firm*—Jacques Dulin; Robert Dennis; Heller Ehrman White & McAuliffe

[57] ABSTRACT

A safety barrier for wheelchair lifts is disclosed, and more particularly a safety barrier assembly which can be used singly or in opposed pairs to open automatically and mechanically in cafe-style, rotating 90° from a first closed or barrier position to a second, open, pass-through position. More particularly, these barriers may be used as barriers on wheelchair lift platforms or at the door opening of a van or transit vehicles on which a wheelchair lift is mounted. The barriers typically are shaped like the letter P with the lower most barrier member being spaced from twelve inches to two feet above the floor, and which are designed to prevent wheelchairs from rolling out of the van when the platform has left the transfer level (vehicle floor), and as a safety barrier in the case of runaway wheelchair events. The preferred embodiment of the gate is mounted to a pivotal cam slot/bias spring assembly which provides for stable open and shut positions with spring/gravity assisted closure. The preferred embodiment also includes a safety interlock switch circuit which prevents lift platform motion when the gate barrier is open.

12 Claims, 7 Drawing Sheets

PIVOTING SAFETY BARRIER FOR WHEELCHAIR LIFT

RELATED APPLICATION

This Application is based on U.S. Provisional Application No. 60/096,539 filed Aug. 13, 1998 by the same inventors and entitled PIVOTING SAFETY BARRIER FOR WHEELCHAIR LIFT. The priority of this application is hereby claimed under 35 USC §119.

DESCRIPTION

1. Technical Field

The invention relates to safety barriers for wheelchair lifts, and more particularly to safety barrier assemblies which can be used singly or in opposed pairs to open in cafe-style, rotating 90° from a first closed or barrier position to a second, open, pass-through position, either manually or powered for automatic opening/closing. More particularly, these barriers may be used as barriers on wheelchair lift platforms or at the door opening of a van or transit vehicles on which a wheelchair lift is mounted. The barriers typically are shaped like the letter P with the lower most barrier member being spaced from twelve inches to two feet above the floor, and which are designed to prevent wheelchairs from rolling out of the van when the platform has left the transfer level (vehicle floor), and as a safety barrier in the case of runaway wheelchair events.

2. Background of the Invention

Wheelchair lifts for vehicles such as vans and buses are offered by a number of manufacturers, including the Braun Corporation of Winamac, Ind. in its L900 series of lifts, as disclosed Goodrich U.S. Pat. No. 5,261,779 issued Nov. 16, 1993 entitled DUAL HYDRAULIC, PARALLELOGRAM ARM WHEELCHAIR LIFT, which is hereby incorporated by reference. Ricon Corporation of Pacoima, Calif. offers a similar parallelogram lift as its S2000 and S5000 (commercial grade) model lifts. Wheelchair lifts of this type in operation cause the wheelchair lift platform to move from a ground level loading/unloading position upward to a horizontal transfer level position adjacent the vehicle doorway at or near vehicle floor level, and vice-versa. Such lifts also generally provide for a stowage position when the lift is not in use. The Braun and Ricon parallelogram lifts tilt upwards to stow. In the Braun UVL and UFL lifts, the lift platform is retracted under the vehicle or vehicle floor, respectively, to stow.

A number of safety mechanisms are employed in conjunction with wheelchair lifts to provide for the safety of wheelchair occupants while on the platform itself, including an outboard platform roll stop and an inboard platform barriers, such as a bridge plate which, in a raised position, functions as a barrier. Ricon uses a belt suspended between the handholds to stop runaways. However, when the platform is positioned away from the transfer level, e.g., at ground level or in an intermediate position, the vehicle doorway is open and unprotected by platform mounted barriers. This open portal presents a hazard to other wheelchair users still in the vehicle while awaiting their turn to use the lift when the platform has left the transfer level in its descent to ground or during the lift portion of its cycle. It can also pose something of a hazard to able-bodied occupants standing on the vehicle floor adjacent the doorway. This problem is exacerbated where the vehicle is on a slanted or crowned roadway. or sloping parking lot. The vehicle tilts to the lift side as the lift plus occupant are cantelevered-away from the vehicle during the lift cycle. This tilt causes the vehicle floor to slope toward the open door.

Interior raisable bridgeplate or footplate type barriers on the order of 8–15" in width (height) have been proposed. However, the dimensions of the type of barrier that lifts from the vehicle floor are such that these type of barriers encroach on the interior space and might result in injury to the feet of the wheelchair occupant when struck. More significantly, these types of barriers do not prevent tip-forward of the chair. That is, in the case of a run-away electric wheelchair, the wheelchair occupant can be hurled out of the vehicle when the front wheels strike the raised floor barrier, since the momentum causes the chair to pivot rotationally on the front wheels. The occupant could be catapulted out of the chair by conservation of momentum which is transferred to the occupant upon an abrupt stop of the wheelchair.

A belt slung across the wheelchair platform between raised side arms with an electric interlock to the lift up-down power system is shown in Ricon's Tremblay U.S. Pat. No. 5,373,915. It is simply an automotive seat belt slung in mid air at stomach or chest height. It has the same disadvantage as an automotive belt, in that it can cause "clothesline"-type injury to the internal organs, stomach, chest or neck in the event of a run-away chair on or onto the platform. The belt, when struck by the occupant can also cause the wheelchair to tilt over backwards, potentially resulting in the occupant, hitting his/her head on the platform, which could result in a concussion. In short, a belt slung across the platform is an idea lifted from automotive belts that, in the above-referenced configuration is not well adapted to the special problem of wheelchair lifts: It tends to guard against catapulting at the expense of a potentially lacerated liver, broken neck, and/or concussion.

Further, a platform-mounted belt does not address the issue of the open portal of the vehicle, which presents a hazard to the other wheelchair users still in the vehicle while awaiting their turn to use the lift when the platform has left the transfer level in its descent and lift portions of its cycle, particularly where the vehicle experiences floor tilt.

Accordingly, there is a need for an improved and higher level interior barrier at the vehicle portal that effectively provides a safety barrier for wheelchair users and provides an interlock keyed to the position of the platform to stop further movement when the barrier is opened, yet can be easily and selectively moved by able persons to an out of the way position to permit their ingress and egress.

SUMMARY, OBJECTS AND ADVANTAGES OF THE INVENTION

It is among the objects of this invention to provide pivoting safety barriers, used singly or in opposed pairs, cafe-door style, which manually or under power pivot from a first, transverse barrier position to a second, parallel passage position and which have an electric safety interlock to stop and/or prevent the operation of the lift when the safety barrier is opened. It is another object of this invention to provide pivoting safety barriers, preferably of a P-shaped configuration, for wheelchair lifts which provide safety against wheelchair tip-forward in the event of runaway wheelchair events and which do not interfere with the operation of the lift. It is another object and advantage of the safety barriers of the invention that when mounted in a vehicle in association with the lift stanchions provide safety for wheelchair occupants still in the van by offering a barrier against them rolling out the doorway when the lift is away from the transit level, particularly when the vehicle floor tilts, yet at the same time permit an able bodied person to exit or enter the vehicle through the vehicle doorway by manually pivoting the barriers. It is an advantage of the invention that the safety barriers can be provided in either a manual or a completely mechanical, automatic or powered embodiment, and they are easily adapted for mounting in a variety of locations on the wheelchair lift itself, or in association with lifts mounted in transit vehicles, vans and other conveyances. It is another object and advantage to provide a mechanical key and slot interlock alternative in which the barrier gate(s) are prevented from being opened during either or both of lift movement away from the transfer level or to/from stowage. Still other objects and advantages of the invention will be evident from a detailed study of the specification and drawings.

The invention is directed to wheelchair lift safety barriers which pivot from a first barrier position across (transverse to) the direction of passage through the related vehicle doorway to a second, open position (parallel to the direction of passage). These barriers may be used singly or in opposed pairs (cafe-door style). The safety barriers of the invention may be employed in a variety of locations and mountings. The principal embodiment described below is preferably mounted in association with a wheelchair lift installed in the doorway of a vehicle, so that the barrier protects the open portal that exits when the lift platform is at ground level or in transit away from the transit level (vehicle floor). As placed adjacent the vehicle entry, the inventive barriers not only prevent wheelchair tip-forward, but also provide a safety barrier for wheelchair users waiting in the vehicle for a first wheelchair user to complete transit on the lift platform after the platform has left the transfer level. The barriers of the invention may also be installed on a lift platform at outboard, inboard or intermediate locations, as a floor or vehicle frame mounted barrier in a vehicle doorway, or in any other passageway where a safety barrier is required.

The barriers may be manually operated by being pushed open with the closure being spring biased, or they may be powered, and optionally keyed to the lift cycle to automatically open when the lift arrives at the transfer level, e.g. by the deployment of the inboard barrier actuating a contact or proximity switch to actuate a gate opening motor.

In the principal embodiment, the pivoting barriers of this invention are mounted to the inboard lift structure, such as on one or more stanchions of a wheelchair lift adjacent a vehicle side or rear doorway. The frame of reference used herein to describe this exemplary installation is a left hand drive-oriented vehicle with forward and rear directions indicating position with respect to the vehicle longitudinal axis. The lift and barrier may also be installed on the left side or rear portion of the vehicle, if desired. Paired P-shaped barriers are mounted in opposed, cafe-door orientation, one at the forward and one at the rear side of the lift. In a typical parallelogram type lift, such as disclosed in the above mentioned U.S. Pat. No. 5,261,779, the pair of parallelogram lift arm assemblies are pivoted from robust, vehicle-mounted stanchions or supports located at the inboard forward and rear sides of the lift, and these supports are convenient and stable mounting locations for the barrier of the invention as used in a doorway installation.

Each gate has a barrier structure, which may include a plurality of sub-members which preferably lie generally in a plane, but may be concave or otherwise non-planar. The barrier gates may be tubular assemblies in which the tubular portions of the gate form the barrier structure, which may be an open or closed loop shape. The preferred gate is P-shaped in configuration as seen in vertical elevation, the gate comprising a vertical pivot (gate) leg, an upper generally horizontal arm, a generally horizontal lower arm and a connector member which joins the two arms at their outward (distal) ends, spaced from and generally parallel to the pivot leg. The lower end of the gate pivot leg terminates in an elongated stanchion section.

The gate stanchion is rotatably mounted in a controlled-force pivot assembly. The controlled-force pivot assembly both pivotally supports the gate, and preferably also provides a stabilizing force when the gate is closed, provides a restoring force as the gate is opened and/or provides for a controlled stability point in the fully open position so that the gate will close automatically once gate closure is initiated.

The preferred pivot assembly includes a cylindrical support sleeve into which the gate stanchion is journaled. In this exemplary installation, the sleeve is securely mounted by bolts, welds or other fasteners to the inboard face of the lift stanchion. Both gate stanchion and sleeve are cylindrical tubes sized with just sufficient clearance therebetween to permit stable, rotational support. Preferably the sleeve may be enclosed by a housing. The housing may be mounted to the lift stanchion, independent of but enclosing the sleeve. Alternately, the sleeve may be mounted to the housing which in turn is mounted to the lift stanchion. In another alternative, the sleeve may be formed in or part of the stanchion with the gate leg projecting upwardly from the stanchion. The housings are located sufficiently to each side of the passageway so as not to impede passage when the barriers are rotated to the open position. The rear (aft) P gate, sleeve and housing are preferably substantially a mirror images of the forward barrier, sleeve and housing, in a pq relationship.

Although each gate is preferably formed by a tube bent into the P-shaped loop, in the alternative each gate may be built up from separate tube portions and joined by welding or other bonding means. The barriers are preferably constructed of relatively large diameter tubing, on the order of 1½–3 inches in diameter, stainless steel or aluminum, and are preferably padded for safety, such as with polyurethane foam tubing. The lower arm member is generally spaced from approximately 12–24 inches above the passageway floor and the upper arm is mounted in the range of 30–60 inches in height above the passageway floor. When mounted in pairs of facing P-shaped gates, as in the preferred embodiment, the connector members are typically spaced to reach just short of the centerline of the passageway, so that a small space exists between the adjacent gates of the barrier when each is in the closed position. The spacing is not so small as to present a scissor action that could pinch fingers or hands; also the foam padding offers added protection against injury from the swinging doors striking a person or a person hitting the doors. Indeed, the closing of the doors may be damped, either by a torsion spring, or by hydraulic damping, so that closing is progressively slowed to prevent closure injury.

The lower arm of the P-shaped gate is sufficiently high to provide a positive stop of a wheelchair occupant, being generally located above the ankle level when the wheelchair occupant's foot is on the wheelchair foot plate, and below the knee level. The upper arm can be as low as mid-chest level and as high as above normal head level for a person seated in a wheelchair. Where the term "wheelchair" is used in this application, it should be understood to also include a variety of both manual and electric chairs, scooters and the like, both powered and attendant operated. The gate material for the preferred construction is two inch diameter stainless steel or aluminum tubing, and includes a sleeve of safety material, preferably the urethane safety foam of DOT yellow. The tubing is sized for ease of gripping and the foam provides not only a resilient safety cushioning, but also a good gripping surface which does not conduct cold. Preferably the internal space within the loop of the P shape is filled by a web of safety netting or strapping of nylon, polyester or other material, which is mounted to the tubular gate structure. Alternatively a clear, or warning labeled or colored unbreakable glass or plastic insert may be used in the open loop portion of the P. Suitable plastics include acrylic, polycarbonate, polystyrene or other comparable plastic.

The rotational motion of the gate is preferably controlled by the controlled-force pivot assembly. The pivot assembly preferably includes a gate raising mechanism to cause the stanchion and gate to rise vertically as the gate is moved from a closed position towards an open position, thus providing a gravitational restoring or closing force. The pivot assembly also preferably limits the gate to a preselected pivoting range.

In the preferred embodiment, the pivot assembly gate raising mechanism includes a cam-and-follower mechanism supporting the stanchion in the vertical axis, and controlling the motion of the stanchion as journaled in the sleeve. Preferably the cam-and-follower mechanism includes a curved cam slot machined in the wall of the tubular sleeve extending about one-quarter to three-eighths around the circumference of the sleeve. The slot is curved to vary the vertical position of the lower lip of the slot around the circumference. A pin is fixedly mounted medially in the stanchion section extending perpendicular to the stanchion through the cam slot. Thus the pin supports the vertical weight of the P gate unit, and causes the gate to move vertically in coordination with rotational motion as the pin follows the slot lip in the support sleeve. Although the cam slot may be configured to permit rotation through any desired angle, the safety gate is preferably configured to rotate only through an angle of about 90 to 130 degrees from a closed position (transverse the passageway) inwardly into the vehicle to an open position. The pin is preferably mounted by threads to a threaded hole in the stanchion section, to facilitate assembly and installation of the barrier.

In a first preferred embodiment, each gate of the barrier is manually operated by rotating it towards an open or closed position. The internal cam slot is preferably curved to have a high point of its lower lip at a point intermediate to the open and closed position, curving down to minimum detent levels at the open and closed positions, with the vertical position preferably being lower when closed than when open. This curvature causes the open and closed position to be stable positions due to the weight of the barrier. Thus the preferred pivot assembly applies controlling force by the effect of gravity guided by the cam and follower.

Alternative cam-and-follower type mechanisms can be substituted for the cam slot and pin system described above, for example a downward oriented pin or roller follower on the lower end of the stanchion, bearing on an upward oriented cam profiled surface mounted to the sleeve housing. Likewise, the cam element may be mounted to the stanchion and the follower element may be mounted to the sleeve or sleeve housing. Other alternative gate raising mechanisms may be employed, such as mated helical screw threads on stanchion and sleeve or a cable or linkage assembly supporting the stanchion which is "wound up" around the stanchion circumference as the stanchioned is rotated, thus raising the stanchion.

In the preferred embodiment, the pivot assembly also includes at least one bias or return spring to assist in biasing the gate towards the closed position, so that it closes automatically after opening and requires some positive force to open. Various types of spring installations may be used. For example, as the gate opens, the spring may be disposed to stretch in torsion so as to urge the gate to pivot back towards a closed position. Alternatively, as the gate opens, the spring may be disposed to stretch in tension (or compression in the opposite direction) as the gate stanchion lifts by the action of the cam guide, so as to urge the stanchion back downwards (and pivotally closed by the reverse action of the cam guide). Likewise, the spring may provide a combination of torsion and tension (or compression, as in the preferred embodiment described in detail below. The shape of the cam slot preferably includes a stable "open" position so that a light pressure is required to initiate closing, after which the gate closes automatically.

When installed as paired gates, the two sides of the barrier may be operated independently, such as where an able-bodied occupant opens one side of the barrier (one gate) to step through without affecting the barrier function of the other side gate in protecting wheelchair occupants in the vehicle.

The sleeve preferably is spaced in the housing above its lower end, and the lower portion of the vertical stanchion section protrudes below the sleeve. The vertical motion of the bottom end of the stanchion may be used to impact and operate a spring-type interlock switch ("kill switch") mounted in the lower portion of the housing adjacent the bottom end of the stanchion. Preferably the switch is of the normally-open type, with the switch being held closed by the lower end of the stanchion section when the barrier is fully closed and the stanchion is at its lowest point. The switch opens when the barrier is moved to an intermediate or open position with consequent rise in stanchion level.

The safety interlock causes the wheelchair lift power source or hydraulic pumps to be shut off by the kill switch, interrupting ground if either gate of the barrier is inadvertently opened when the lift platform is not at floor level. In a typical parallelogram-type lift of the type disclosed in the above mentioned U.S. Pat. No. 5,261,779, the platform is hydraulically lifted from ground level to transfer level, and is moved "gravity-down" in the reverse direction by releasing the hydraulic pressure in the lifting cylinders by activating/opening a normally-closed solenoid valve. The interlock can be configured to lock out the pump and to break the solenoid circuit when the inventive safety interlock switch of either gate is "open," thereby locking out both pumping (upward lift motion) and pressure release (downward lift motion) when the barrier is moved from the closed position. The safety interlock can also include a normally closed type switch, and may provide a signal to actuate other controls or warning systems, such as a dashboard mounted safety gate status light, audible alarm etc.

Purely mechanical interlocks are feasible whereby the motion of the lift away from the floor level transfer position causes the barrier to be locked in a closed position. Parallelogram lifts typically have an upper parallelogram arm pivoted adjacent the inboard edge of the lift support stanchion. Where the barrier of the invention is installed adjacent the inboard face of the lift support stanchion, an inboard finger or cam-like extension can be mounted to the upper parallelogram arm, the cam-like extension being positioned and contoured so that as the lift moves downward from the transfer level, the cam-like extension rotates with the parallelogram arm to move into a vertical slot formed in the barrier vertical leg member, the slot being positioned to face the parallelogram arm only when the gate is in the closed position. Thus the cam-like extension automatically acts as a lock to prevent gate rotation until the lift returns to the transfer level.

Alternatively, the anti-barrier rotation interlock can be an electromechanical or hydraulic system, such as a solenoid actuated rod which engages a hole in the stanchion preventing rotation. The solenoid may be electrically actuated by a contact or proximity switch located in association with the lifting mechanism (e.g., a parallelogram arm) or the platform so that when the lift platform leaves the transfer level the gate is prevented from being opened, unless overridden or mechanically released by a trained attendant.

Parallelogram type lifts typically are stowed by rotating the platform to a vertical or over-vertical position lying adjacent the side of the vehicle inside the doorway. The outboard lip of the platform is generally fitted with a roll stop which may project inward towards the vehicle interior when the lift is in the stowed position. The height of the upper arm of the inventive barrier, when in the closed position across the doorway, is preferably selected to match that of the roll stop when in the stowed position, thereby providing a padded protective covering to the roll stop, protecting vehicle occupants in the event of a collision. Also note that the safety interlock "kill switch" described above will limit stowage overrun in the event that the impact of the roll stop during stowage causes the barrier to move inward from the closed position.

In addition to direct mounting of the housing to a wheelchair lift structure, the housing may be mounted to a vehicle frame, or to a bracket mounted to the vehicle floor structure or framing. These alternatives provide flexibility of mounting location within a vehicle or other location of use, such as when used in a doorway fitted with a telescoping header-type lift, or to step wells fitted with telescoping under-floor or under-vehicle type lifts. These latter two typically do not have support structures located above the vehicle floor level. The barrier of the invention may be employed as a doorway barrier mounted to header lifts such as the Braun 200, 900 and Millennium Series™ lifts, or the Ricon parallelogram S2000 and S5000 series lifts. In a free-standing, floor or vehicle frame mounted configuration, the barrier of the invention may be employed with many other lift types, such as with the Braun 600 series under-vehicle lifts, the Braun 1000 series under-floor lifts, or with the Ricon Mirage and Eclipse models of under-vehicle lifts.

In the powered embodiment, an electric or hydraulic motor may be linked to the gate stanchion, leg or either of the arms to open the gate, and optionally, close it. The motor may be actuated by manually actuating a switch, such as a rocker switch in the lift control box, or preferably may be linked to the position of the lift in its cycle. A contact or proximity switch may be positioned in any convenient location on the lift, e.g., the lifting assembly, mounting plate, platform or inboard barrier, so that when the lift arrives at the transfer level, the motor is powered to open the gate, limit switche(s) shut it off when the gate is fully opened, and the gate closes when the lift leaves the transfer level, e.g., upon the inboard barrier being disengaged from contact with the vehicle floor, the bridgeplate or mounting plate, as the case may be. The electrical and mechanical circuitry are straight forward, given these principles and functionality, and well within the skill in the art to realize for commercial operations.

BRIEF DESCRIPTION OF THE DRAWINGS

The invention is illustrated in the drawings in which:

FIG. 5 showing the position with the gate partly open; and FIG. 6 showing the position with the gate fully open;

DETAILED DESCRIPTION INCLUDING THE BEST MODES OF CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what is presently believed to be the best mode of carrying out the invention.

In this regard, the invention is illustrated in the several figures, and is of sufficient complexity that the many parts, interrelationships, and sub-combinations thereof simply cannot be clearly or meaningfully illustrated in a single patent-type drawing. Accordingly, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications and patent applications cited in this specification are herein incorporated by reference as if each individual publication or patent application were specifically and individually indicated to be incorporated by reference.

Figure 1:
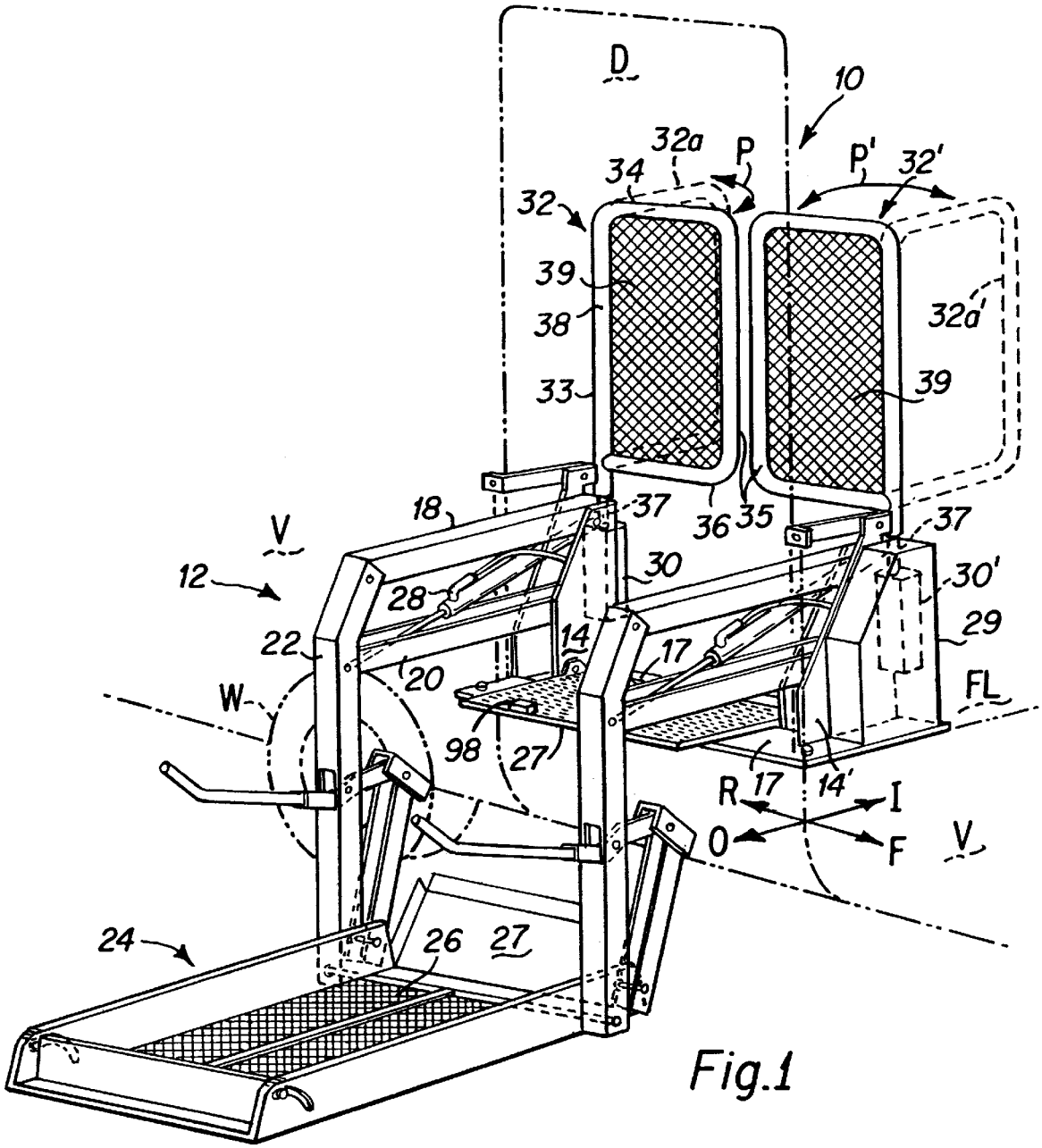
FIG. 1 is an isometric view of the dual, opposed, P-shaped, gate barrier assembly of the invention as mounted adjacent the stanchions of a typical parallelogram lift installed in a vehicle right side doorway, seen from the perspective of one standing outside the vehicle; the open gates are shown in phantom.

FIG. 1 is and isometric view of the P-gate safety barrier assembly 10 of the invention as mounted to the inboard end of a typical parallelogram lift 12 installed in a right side doorway D of Vehicle V as viewed from outside the vehicle. The doorway D is located forward of rear wheelwell W, the vehicle frame of reference being shown by the Arrows F and R indicating the forward and rearward directions and the Arrows O and I indicating the outboard and inboard directions. For purposes of clarity, elements of the lift and barrier gate assembly are included in the figures as mirror image pairs on opposite side of the plane of symmetry of the wheelchair lift (as illustrated in FIG. 1, this is along the Inboard-Outboard axis, I—O) will generally be labeled with the same number N, the forward side element being distinguished as N'; where only one element is mentioned by number, the other also works correspondingly the same, unless otherwise specified.

The parallelogram lift 12 is supported by a rear lift stanchion 14 and a forward lift stanchion 14' which are mounted to the vehicle floor FL on the corresponding sides of doorway D on doorway threshold plate 17. Each lift stanchion 14, 14' pivotally mounts a pair of upper and lower parallelogram arms 18 and 20 which in turn pivotally connect with a generally vertically disposed lift arm 22. The platform assembly 24 is mounted to and between the lower end of the forward and rear lift arms 22, 22'. The platform floor 26 being typically constructed with a non-slip mesh surface. The platform 24 is shown in FIG. 1 at the ground level loading position with bridgeplate 27 in an upturned position to form an inboard platform barrier. Bridgeplate 27 rotates to horizontal and overlaps threshold 17 when the platform is raised to the transfer level, so as to form a transition structure to the vehicle floor FL. The lift and platform shown in FIG. 1 is generally as shown in copending application Ser. No. 09/295,066 entitled "Dual Function Inboard Barrier/Bridgeplate Assembly For Wheelchair Lifts", filed Apr. 20, 1999, based on Provisional Application No. 60/083,894 filed May 1, 1998, which applications are hereby incorporated by reference herein. In other lift designs, the bridgeplate may be mounted to the doorway threshold plate 17, and may form the portal boundary.

Forward and rear hydraulic cylinders 28, 28' are pivotally mounted diagonally across the corresponding lift parallelogram for lifting the platform to the transfer or vehicle floor level. Pump housing 29 is shown mounted on the forward face of forward lift stanchion 14'. The platform assembly 24 is pivotally mounted so that from the transfer position it may be rotated upwards and inwards to a stowage position (see FIGS. 2–7 below).

Figure 2:
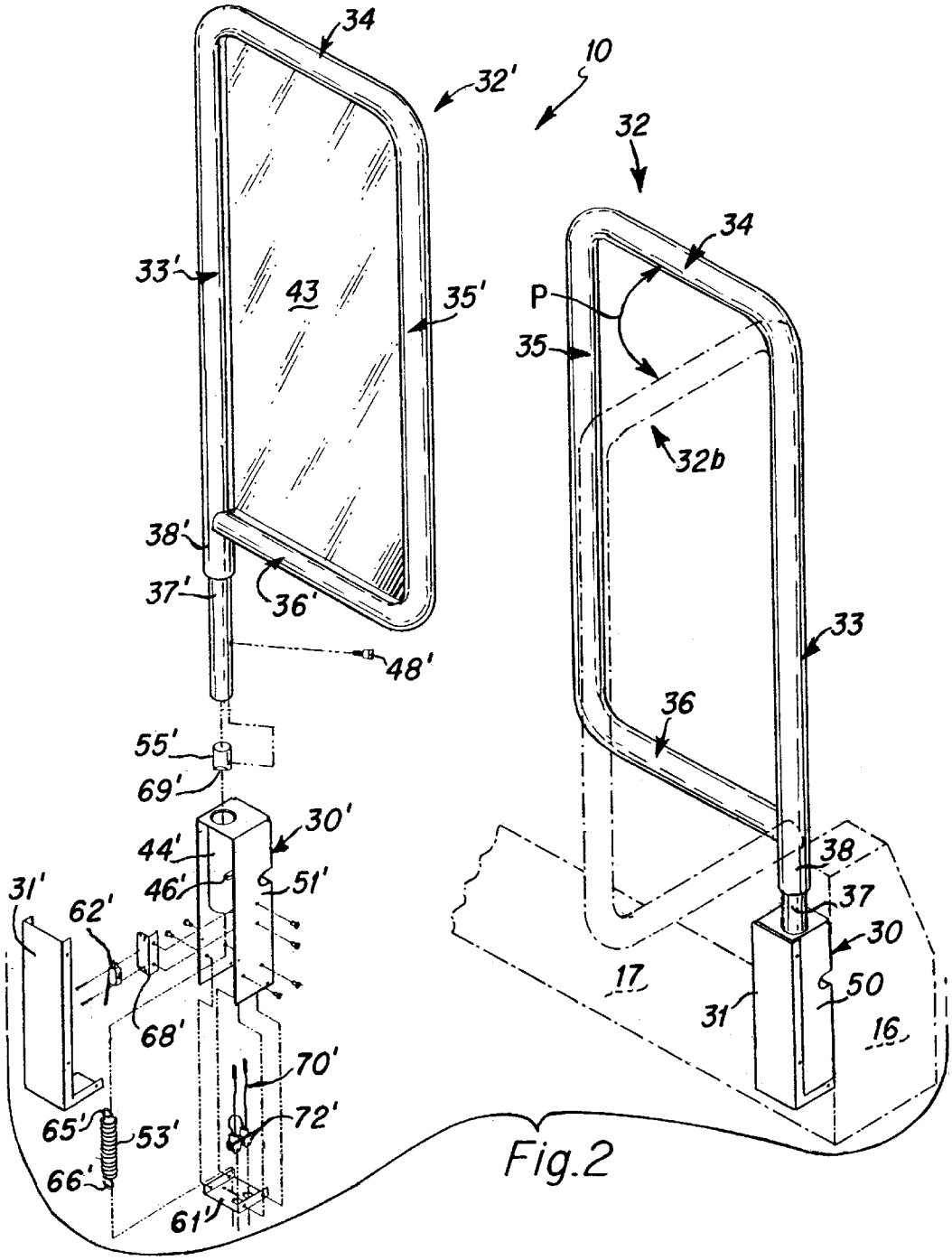
FIG. 2 shows the dual (bilaterally symmetrical), opposed P-shaped, gate assembly as in FIG. 1, seen from the perspective of inside the vehicle, the lefthand gate being shown in exploded view and the righthand gate is shown in assembled view with the closed gate shown in solid lines and the open gate superimposed in phantom lines.

As shown in FIG. 1 and also in FIG. 2, a safety barrier is formed from a pair of facing P-gate assemblies 10, 10' mounted one on each side of the doorway D by means of a vertically oriented forward and rear sleeve housings 30, 30', which are fixedly mounted to the inboard faces of the forward and rear lift stanchions 14 and 16 respectively. Each barrier assembly 10 comprises a P-gate frame 32 having a vertical gate leg portion 33, an upper gate arm portion 34, vertical connecting member 35 (the inner member) and a lower arm portion 36. The P-gate frame 32 is preferably integrally formed from a single section of tubing bent to a generally P shaped loop with smooth corners of generous radii, and with the end of the lower gate arm 36 being joined to the side of gate base 33 by welding or other fastening or bonding means. Alternately, the gate frame 32 can be built up from individual sections 33–36 fixed to the final shape by welding, screws or other bonding or fastening means. Preferably, the opposed gate frames 32, 32' lie in the same plane when closed, i.e., they are mounted in opposed, coplanar facing positions, in a pq relationship. FIG. 1 shows the P-gate frames in a primary or solid image in the closed position 32, 32' and in a phantom image in the open position 32*a*, 32*a'*, pivoted as shown by Arrow P and P'.

The leg base 33 is the longest portion of the gate 32, and extends downward from the loop as gate stanchion member 37 which is pivotally mounted within sleeve housing 30. The tubular loop portion of gate 32 is preferably entirely covered with padding 38, such as surrounding tubular polyurethane foam. Depending on the padding type selected, the padding may be bonded to the tubular frame, held by friction, or fastened by suitable fasteners or clasps. The interior of the P-shaped loop gate 32 is preferably covered by safety net material 39, such as nylon netting or strapping, which is stretched taut and fastened to the loop members of gate 32 by suitable fasteners known in the art. Alternatively, the gate loop may be filled by a panel mounted to the gate by suitable fasteners known in the art. The panel is preferably a transparent and resilient plastic, such as plexiglas or polycarbonate (see panel 43 in FIG. 2).

FIG. 2 shows the dual (bilaterally symmetrical) P-shaped gate assembly 10 as in FIG. 1, seen from the perspective of inside the vehicle. The left-hand gate 32' is shown with sleeve housing 30' and controlled force pivot assembly 41' in exploded view. The right-hand gate 32 is shown in assembled view with the housing cover 31 enclosing controlled force pivot assembly 41 within housing 30. Housing 30 is mounted to the rear lift stanchion 14 (shown in phantom lines with a portion of threshold plate 17).

The left-hand gate is shown both in the closed position 32 in solid lines, together with the open gate position 32*a* superimposed in phantom lines as pivoted in the direction of Arrow P. The spacing between the inner members 35, 35' is somewhat exaggerated for clarity.

Figure 3:
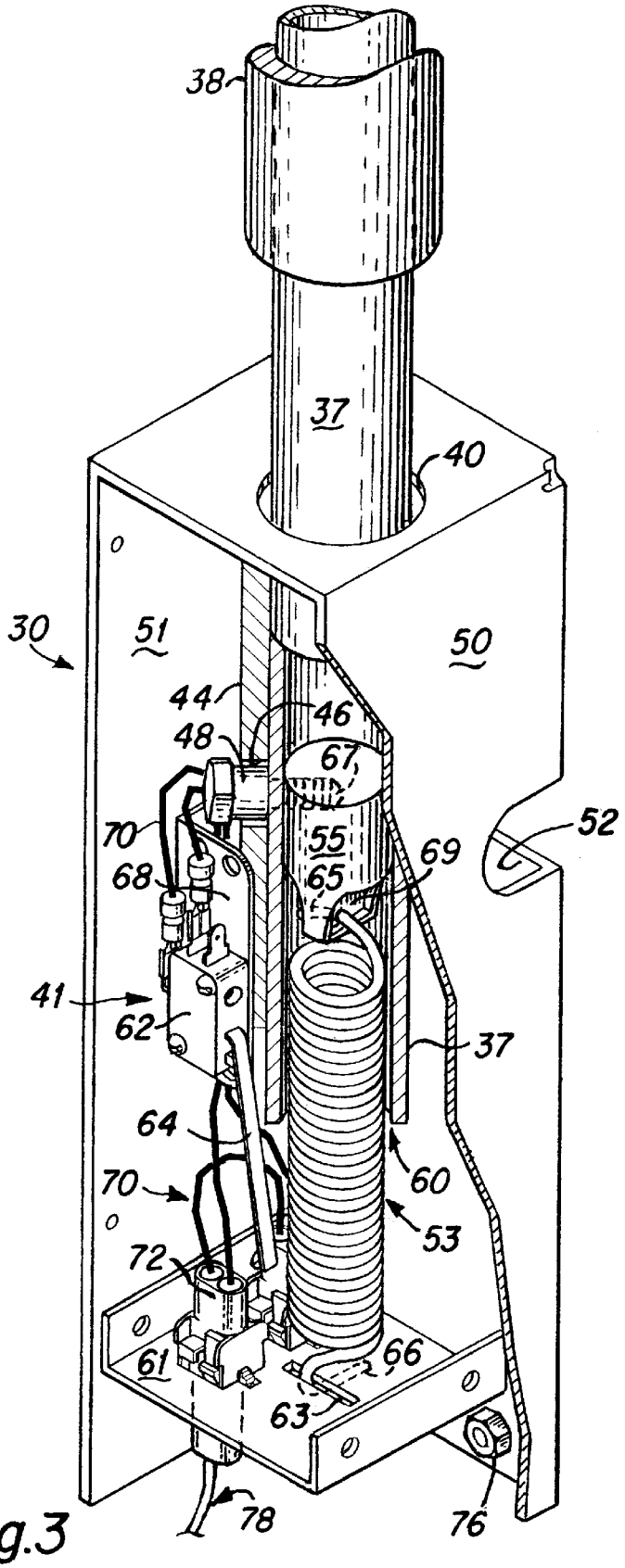
FIG. 3 is a cut away of the P gate sleeve housing showing the detail assembly of the cam follower, gate switch and the preferred bias spring mounted beneath the stanchion.

FIG. 3 is a cutaway detail view of the assembled rear sleeve housing 30 and pivot assembly 41 with a portion of stanchion 37. FIG. 3 shows the assembled internal gate assembly elements corresponding to the opposite side gate internal components of the exploded view of FIG. 2.

It can be seen in FIGS. 2 and 3 (and also generally in FIGS. 4–6 described below) that the lower portion of stanchion 37 passes through aperture 40 in the top of housing 30 to telescope within hollow tubular sleeve 44, passing through the sleeve 44 so that the stanchion lower end 60 projects below the sleeve 44. The sleeve 44 is mounted to housing 30 by welds, bolts or other fastening means (see welds 54 in FIGS. 4–6) adjacent housing outboard side 52 and housing rear side 50. Housing 30, in this preferred installation embodiment, is mounted to the inboard side of lift stanchion or support 14 by suitable fastening means, such as by a plurality of bolts 76 through outboard wall 52.

The stanchion 37 is pivotally secured in sleeve 44 by means of cam follower pin or bolt 48 which passes through cam slot 46 in the side of sleeve 44 and is threaded into the stanchion. In the preferred embodiment, spring attachment plug 55 is inserted within the hollow core of stanchion 37. Tapped hole 67 in plug 55 is aligned with cam slot 46 so that pin 48 may be screwed into plug hole 67, thus clamping plug 55, pin 48 and stanchion 37 together as a rigid assembly, while leaving stanchion 37 free to move pivotally and vertically in sleeve 44 as pin 48 follows the cam slot 46 (see FIGS. 4–6 described below).

In the preferred embodiment, the plug 55 has a lower vertically oriented web 69 which serves as an attachment point for bias coil spring 53, such as by insertion of upper spring end hook 65 through an aperature in web 69. The bias spring extends downward out thought the lower end 60 of stanchion 37 to mount to anchor plate 61, which is in turn mounted to the lower portion of housing sides 50 and 51 by suitable fastening means. The spring 53 may be fastened to plate 61 by insertion of lower end hook 66 in anchor slot 63 of plate 61.

Safety switch 62 is mounted by means of mounting plate 68 to side 51 of housing 30, and is disposed so that switch arm 64 overlaps the end of stanchion 37. Switch wiring 70 connects switch 62 with connector 72 mounted through plate 61 to connect to wiring harness 78, which in turn connects to the lift power system interlock circuitry (77*a* or 77*b* in FIGS. 7A and 7B).

Figure 4:
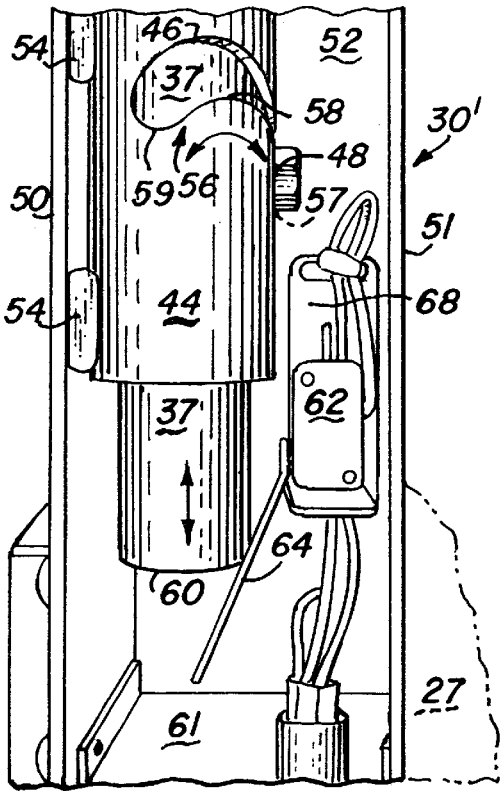
FIGS. 4 through 6 are detail elevation views of the barrier system shown in FIGS. 1–3 as seen from inboard, showing the interior of the forward (left-hand) sleeve housing with the housing cover removed and illustrating the support sleeve, gate stanchion, cam slot, following pin, and safety switch, FIG. 4 showing the position with the gate closed.
Figure 5:
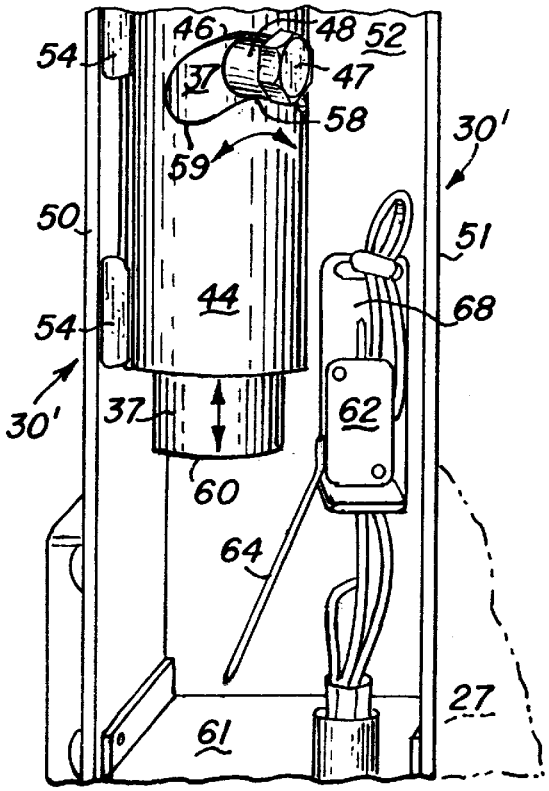
Figure 6:
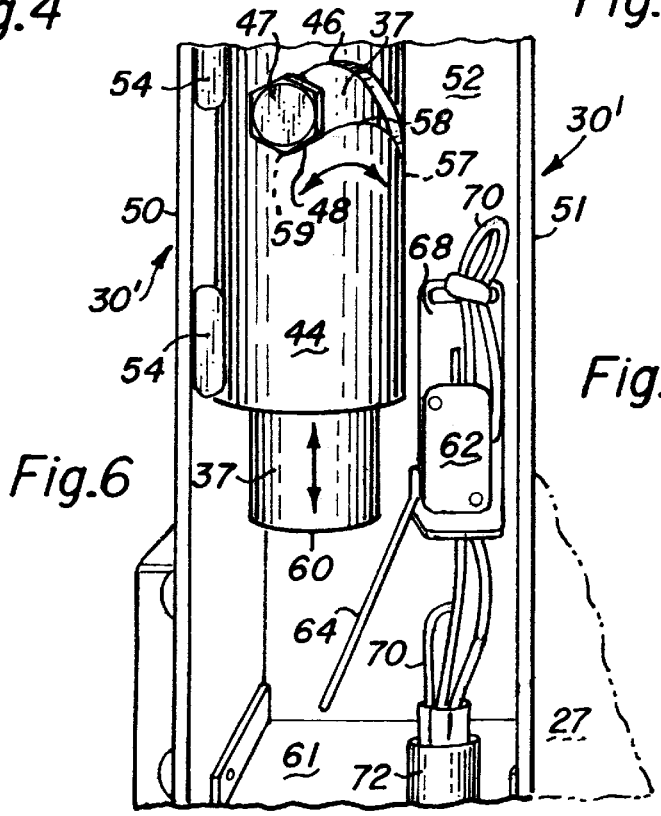

FIGS. 4–6 are views of a portion of the forward sleeve housing 30' as seen from inboard of the housing with the housing cover (31' in FIG. 2) removed. The housing cover 31' may be a simple bent sheet metal channel fixed to the housing with screws or other fasteners. The corresponding sleeve housing elements described below are also included in a mirror image combination as rear sleeve housing 30, and the following discussion may be considered as generic to either housing.

FIGS. 4–6 are a progressive series showing the rotational movement of gate stanchion 37 in support sleeve 44, with its associated cam slot 46 and follower pin 48, and the resultant actuation of the safety switch 62. The sleeve housing 30 and sleeve 44 are preferably constructed of mild steel, although other materials are suitable. The sleeve housing 30 may be formed from a steel channel section having a housing forward side 50, a housing rear side 51, and a housing outboard side 52. In the embodiment shown, the sleeve 44 is welded to the housing forward side by a plurality of weld filets 54, although other types of bonding and fastening means may be used. The lower portion of gate stanchion member 37 can be seen inserted through the sleeve. The follower pin 48 is typically threaded and secured into the stanchion tube by means of a threaded bore (not shown) perpendicular to the stanchion tube surface. The hexagonal head 47 of the follower pin 48 as shown facilitates assembly/disassembly of the cam and follower assembly. In these figures the return spring 53 (FIG. 2) is omitted for clarity.

FIGS. 4–6 show, in sequence, the position of the follower pin 48 and gate stanchion 37 as the gate is rotated from the closed position (FIG. 4) to an intermediate position (FIG. 5) and finally to the open position (FIG. 6). The cam slot 46 has a contoured lower cam lip 56 with a "gate-closed" end 57, a middle portion 58 and a "gate-open" end 59, corresponding to the contact location of the follower pin 48 on the slot lower edge 56, in the closed, intermediate, and open positions of the P-gate (32 in FIGS. 1 and 2), respectively. It can be seen that the gate-closed end 57 of the slot lip 46 is lower than the gate-open end 59, and the middle portion 58 is higher than either end. Thus, as the P-gate and gate stanchion 37 are rotated from the gate-closed position, the P-gate is caused to rise upwards by the action of following pin 48 to a high point at the middle position of the slots, then dropping to an intermediate level at the gate-open position at the other end of the slot.

The contour of the cam slot has at least two benefits. First, there is a gravity stabilized detent at both the open and the closed positions of the P-gate, since the mass of the gate at either end point is below its intermediate level 58. The gate assembly sleeve 44, slot 46 with its two ends 57, 59 and the follower pin 48 comprise a stop mechanism that permits selective opening of the gate inwardly to the vehicle interior while preventing gate opening to the exterior.

If desired, an inverted L-shaped slot, Γ, can be provided extending upwardly from the closed end 57 of the cam slot as an emergency release. An attendant can thus lift the gate member so the pin 48 rises straight up the long vertical leg of the slot, and then turns the gate in or out (depending on the orientation of the short leg) to permit ingress or egress. The lower spring hook may be secured to the anchor plate 61 by a failure release pin, so that in normal operation the spring 53 will prevent lifting the gate member up the Γ-shaped release slot unless the spring is released.

Second, the lower end 60 of stanchion 37 has a vertical position corresponding to the gate position, and thus serves as an actuator for optional safety "kill" switch 62. The switch 62 and switch wiring are mounted to switch bracket 68 which in turn is mounted to the housing inner side 51. The switch 62 is positioned by its mounting so that switch spring arm 64 contacts the stanchion end 60 when the P-gate is in the closed position, but in no other position. The normally-open switch 62 thus only closes (completes) the circuit if the P-gate is closed. The closed circuit position (condition) of switch 62 may be configured to enable either or both of the lift hydraulic pump and/or the hydraulic release/return valve solenoid, so that movement of the lift is only possible with the P-gate closed.

As seen at the bottom of FIGS. 3 and 4–6, the switch wiring 70 and wiring connector 72 mounted to the spring anchor connector plate 61, which is in turn fastened to opposite housing sides 50, 51 with bolts. The connector 72 is a standard quick-connect through-plate fitting known in the art and may be mounted as a pair of such fittings to connect the right housing 30 to the left housing 30', and the pump side housing (30 or 30' depending on lift type) to the lift pump controls. The wiring connector allows the barrier system to be pre-wired at the manufacturing stage, with connectors permitting rapid wiring assembly in the field.

The safety switches 62 of the paired forward and rear P-gate assemblies of the preferred embodiment of the barrier system 10 are wired in series, so that the opening of either one of the doors, or both, will trigger the "kill switch" to arrest lift motion. The connectors 72 on the right and left side housings 30, 30' are preferably identical and each connects to interconnect wiring 78 between the housings. The connector 72 on the same side as the pump housing 29 preferably includes wiring connected to the pump control and gravity down release solenoid. The connector 72 of the opposed P gate instead includes a jumper connection completing the circuit. This optional feature allows the housing pairs 30, 30' to be installed on lifts with pump housings on either side.

As best seen in FIG. 3, lower housing mounting bolt 76 is shown adjacent the bottom of the housing outboard wall 52, and connects to a hole drilled in the inboard face of the lift stanchion 14, a similar bolt (not shown) being located adjacent the top of the housing back and connecting to the lift stanchion in the same manner. Alternatively, the housing may be mounted to the lift by welding or other bonding or fastening means.

One of ordinary skill in the art will be able, without undue experimentation based on this disclosure and known art, to select a profile shape and dimensions of the cam slot 46 and/or elasticity characteristics of spring 53 so as to achieve any of a wide range of desired gate performance characteristics, such gate pivoting angular range, force required to open gate, and force required to initiate gate closure. Likewise, alternative pivot assemblies are feasible where the cam slot "gate closed" end 57 is generally at the same level as the cam slot "gate open" end 59, with the cam slot mid portion 58 being higher than either end 57 or 59. In this alternative embodiment, the "automatic closure" restoring force may be provided primarily by the bias spring, with the cam profile including an end "slot" to provide a stable open position, requiring an initiating "push" to trigger gate closure.

Figure 7A:
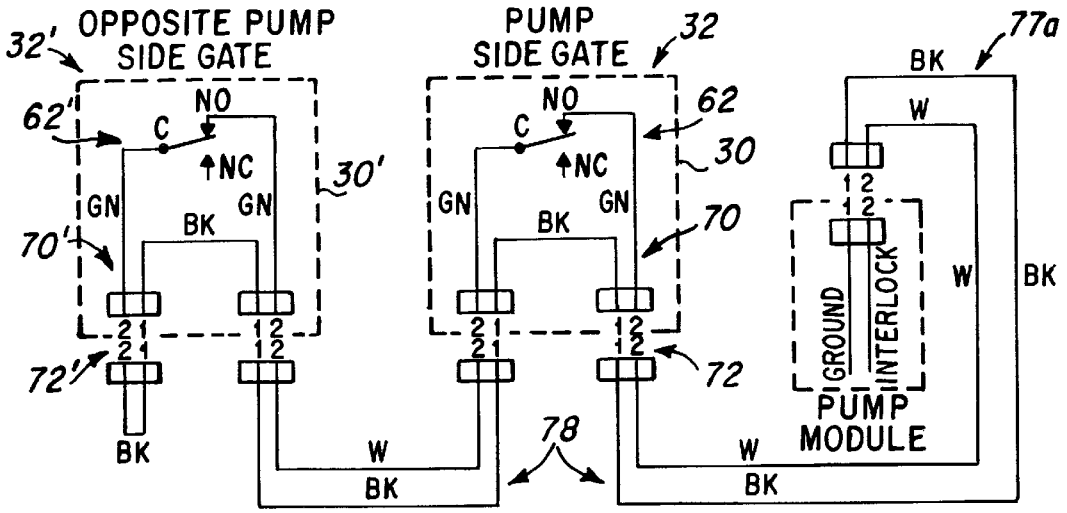
FIGS. 7A and 7B are electrical diagrams of the barrier system of the invention, with FIG. 7A illustrating the electrical layout of a lift not having other standard interlocks (e.g., load sensor kill switches), and FIG. 7B illustrating lifts having other interlocks.
Figure 7B:
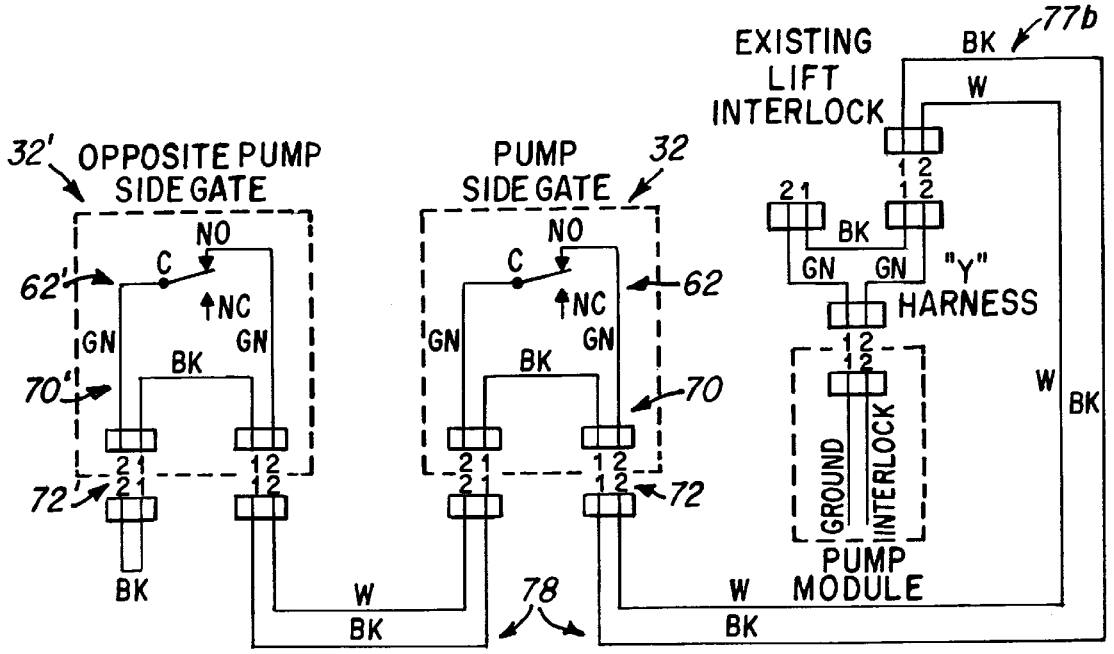

FIGS. 7A and 7B are electrical diagrams of the barrier system of the invention; one skilled in the art can readily derive a corresponding wiring diagram from FIGS. 7A/7B to wire the safety barrier optional electrical interlock circuit of the invention by reference to those figures and the forgoing figures and description. The gate switches 62, 62' are shown connected to the switch wiring 70, 70', which in turn interconnects to the lift power system 77 by wiring harness 78. The interlock acts to disable lift motion when the gate is open, and/or to enable lift motion when the gate is closed.

Many conventional wheelchair lifts include safety interlocks of various designs and purposes, such as overload preventors and the like, which can act to disable or enable lift motion when specified sensor criteria are met. As seen in FIG. 7A, the gate switches 62 of the invention may be interconnected to the lift power control system 77*a* in lifts without such existing interlock devices. Alternatively, as seen in FIG. 7B, the gate interlock of the invention may be interconnected to the lift control systems 77*b* which include existing interlocks, so as to act in cooperative association with such existing interlocks. One of ordinary skill in the art will understand by reference to the disclosure herein, in light of known art, how to assemble the appropriate electronic/electrical or software logic connections to achieve the objects of the P gate interlock compatibly with the objects and purposes of such existing interlock devices.

Alternative gate closure interlocks may include substitute other conventional position sensors to sense the gate position in place of switch 62, such as magnetic sensors or optical sensors. Such alternative position sensors may be conventionally mounted to the pivot assembly, the gate, or both. The alternative sensors can in turn be connected to activate the power system interlock. The interlock logic may include a sensor producing either a signal indicative of a gate open (gate not closed) state to enable a normally-off power system "kill switch" when the gate is open, or a signal indicative of a gate closed state to disable a normally-on "kill switch" when the gate is closed.

Figure 8:
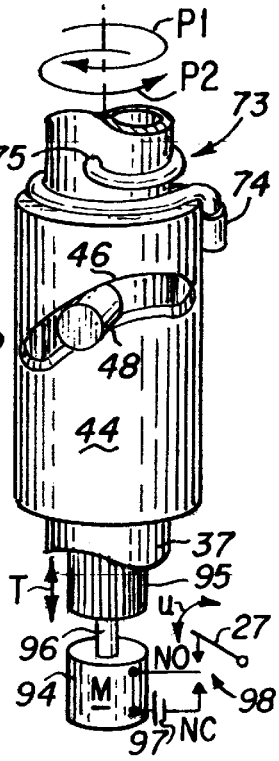
FIG. 8 shows an exemplary alternative bias spring mounted coiled around the outside of the gate stanchion, and a motor for powered operation of the gate.

FIG. 8 shows an alternative embodiment of the bias spring 73 which is mounted outside the gate sleeve 44 coiled around the lower portion of the stanchion 37. The coil torsion spring 73 connects to sleeve ferrule 74 at one end and to stanchion hole 75 at the other end. Opening the gate by pivoting stanchion 37 in the direction of Arrow P1 causes the spring to stretch in torsion so as to urge the gate towards closure in the direction of Arrow P2.

FIG. 8 also shows one exemplary realization of the power embodiment of the invention. Electric motor 94 is connected to spline 95 (the spline groove(s) being shown schematically) by take off shaft 96. The spline 95 permits the motor to rotate the stanchion tube 37 while it reciprocates up and down as indicated by Arrow T. The motor electrical wiring is shown schematically, being powered off vehicle battery/alternator 97. A hydraulic motor may be substituted for the electrical motor. Switch 98 which may be mounted to the threshold plate 17 (FIG. 1) is shown as a contact or proximity switch 98 which is actuated to power the motor when the inboard barrier/bridgeplate 27 (FIG. 1) descends to engage threshold plate 17 when the lift arrives at the transfer level (FIG. 10) as shown by Arrow U. Thus, the motor opens the gate only when the circuit is complete by arrival of the lift at the transfer level. The motor winds or extends the spring 53, 73 open opening, and the gate thus can be spring biased close automatically upon release of rotational motor power when the platform leaves the transfer level. In the alternative, the motor can reverse to rotate the gate to the closed position.

Figure 9:
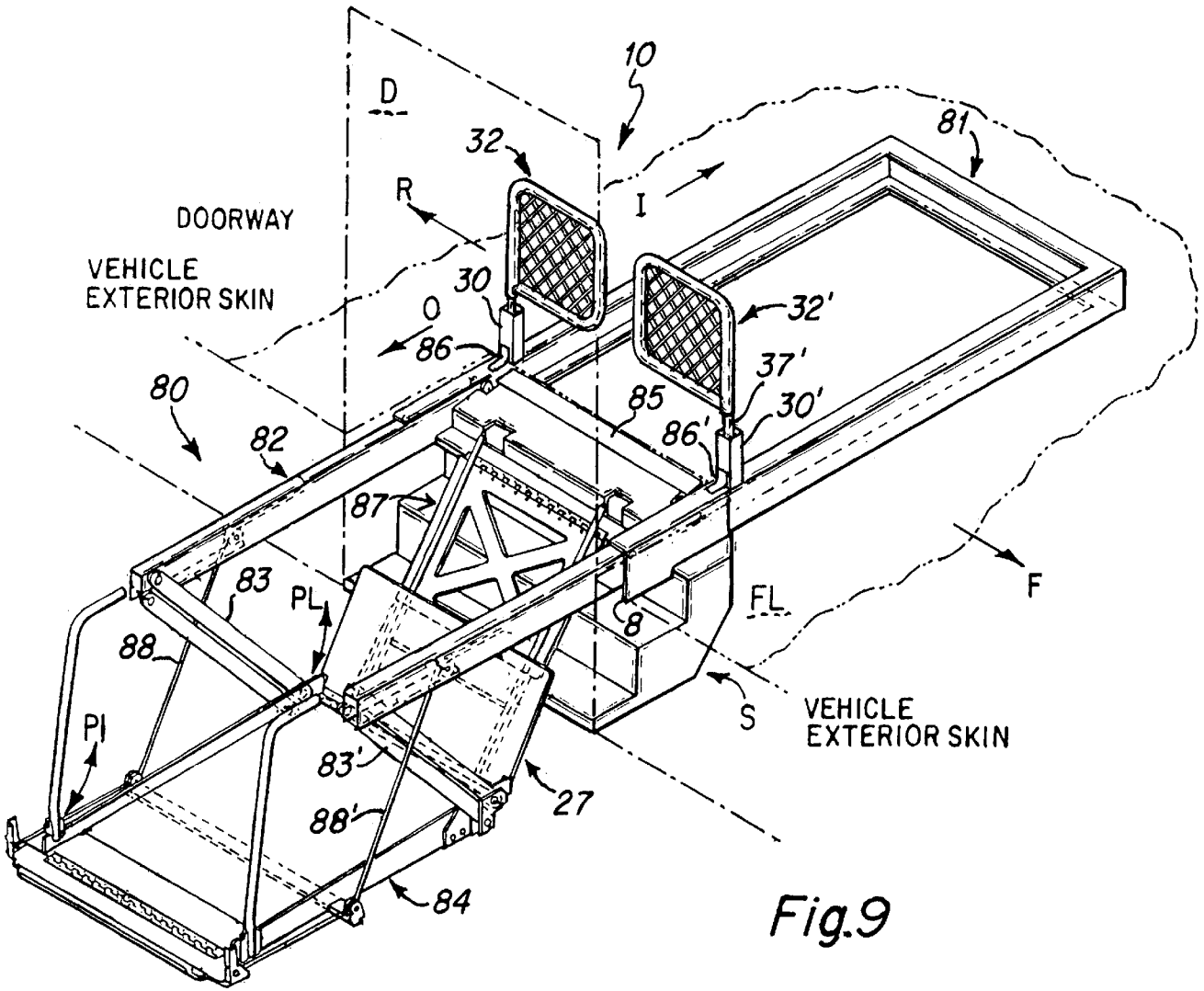
FIG. 9 is an isometric view of the P-gate barrier system of the invention as installed on a transit bus in association with an under-floor lift of the Braun-1000 series type.

FIG. 9 is an isometric view of the P-gate barrier system 10 of the invention as installed on a transit bus in association with a retractable under-floor lift (UFL) 80 of the Braun-1000 series type such as in copending Ser. No. 09/065,666 filed Apr. 23, 1998 now U.S. Pat. No. 5,975,830 entitled "Under Floor Wheelchair Lift", shown in the extended position with platform assembly 84 lowered to ground level. The UFL U-shaped header frame 81 is mounted underneath the vehicle floor and projects along each side of stairwell S. The telescoping U-shaped carriage frame 82 is slidably mounted and nested in the header frame 81. The platform assembly 84 is supported a pair of parallelogram linkages 83, 83' and is lifted/lowered by a pair of lift cables 88, 88' descending from the carriage frame 82. The hydraulic power and lift cable retraction system is housed within the carriage frame and is not shown. The bridgeplate assembly 87 telescopingly connects the carriage frame with the platform to brace the platform during motion. In this platform-down configuration, the boundary of the vehicle floor adjacent the doorway D is formed by sill plate 85 mounted to the top of the carriage frame 82. When the platform 84 is at the vehicle floor level, the sill plate 85 mates with the bridgeplate 87 to form a transition structure between floor and platform 84. The gate sleeve housing and mounting assembly 30, 30' of the P-gate barrier assembly 10 are mounted by means of housing mounting brackets 86 and 86' which are bolted or fixedly mounted to the floor FL, or to the header frame 81 adjacent the sides of sill plate 85 and adjacent the top of the stairwell S at each side of doorway D. In this transit-type bus installation, the top riser of stairwell S is inboard of the doorway, as the bottom step is adjacent to the doorway opening, and thus the barrier location is likewise inboard from the doorway opening. The P-gates 32, 32' are pivotally mounted to the sleeve housings 30, 30' as described above with respect FIGS. 1–8. While only one bracket 86, 86' is shown to mount each sleeve assembly 30, 30', it should be understood that as many as needed for rigid, heavy-duty use are employed. One preferred system would be a floor-mounted drop-in socket for the free-standing embodiment of the invention.

Figure 10:
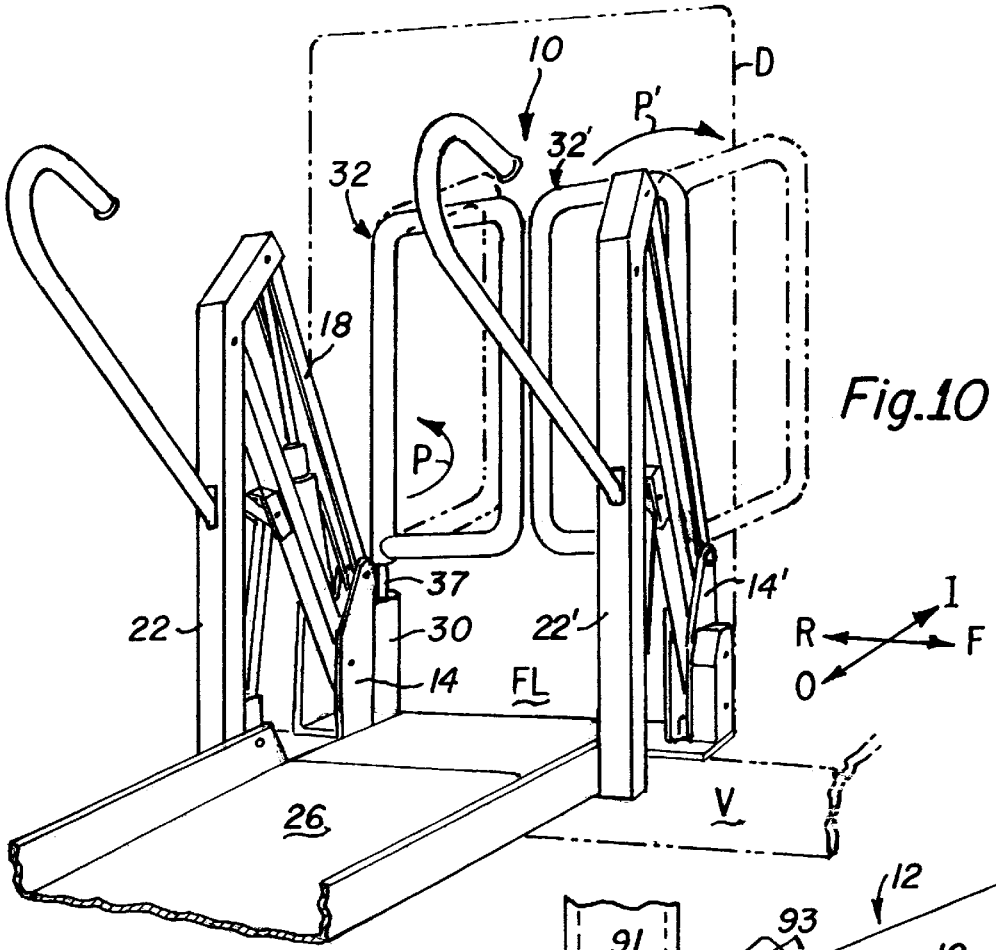
FIG. 10 is a view of the barrier system of the invention as installed on a Ricon type lift as seen in a inboard elevation.

FIG. 10 is a view of the barrier system 10 of the invention as installed on a Ricon type parallelogram lift, FIG. 10 being an outboard isometric elevation with the platform at transfer level. Although this is a different lift design than the Braun type lifts shown in FIG. 1, the analogous element labels are used for similar parts and reference is made to the description of FIGS. 1–8 above to describe such analogous elements. P-gates 32, 32' are pivoted from sleeve housings 30, 30' which are in turn mounted to lift stanchions 14 and 14'. When lift platform 26 is away from the transfer level, the next-in-line waiting wheelchair user(s) are protected from rollout by the closed barriers 32, 32'. Webbing or plastic (39, 43 in FIGS. 1 and 2) in the P loop is not shown for clarity but is preferred.

Figure 11A:
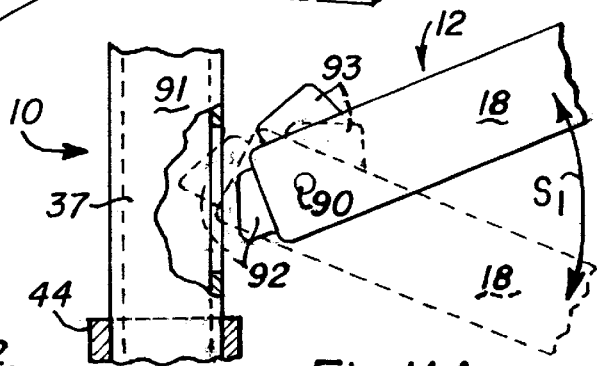
FIGS. 11A and B are side elevation views of an optional mechanical interlock for the barrier of the invention as installed on a parallelogram lift as shown in FIG. 1.
Figure 11B:
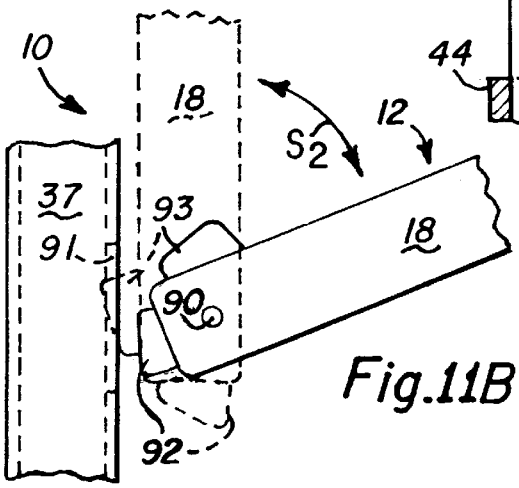

FIGS. 11A and B are side elevation views of an optional mechanical interlock for the barrier 10 of the invention as installed on a parallelogram lift 12 as shown in FIGS. 1 and 10. The gate stanchion is in the closed position. The upper parallelogram link 18 which is pivoted on pivot 90 adjacent the upper inboard face of the lift stanchions (14 and 14' in FIG. 1) has a cam-like extension 92 which faces inboard towards adjacent gate stanchion 37. Gate stanchion 37 has a vertical slot 91 located so that upon downward rotation of the parallelogram link 18, the cam extension 92 inserts into slot 91, locking the gate stanchion 37 against pivoting. The angular location of slot 91 is selected to align with the cam 92 when the gate is closed. The cam 92 is positioned and the contour of the cam selected so that it is outside the slot 91 when the lift 12 is at the transfer level and the link 18 is pivoted to its corresponding angle (shown in solid lines in FIG. 11A), and thus the gate is free to open. As the lift 12 lowers toward ground level (Arrow $S_1$ in FIG. 11A), the link 18 (shown in dashed lines in FIG. 11B) rotates to insert the cam 92 into slot 91, locking the gate until the lift returns to transfer level. As seen in FIG. 11B, a similar cam-like extension 93 may optionally be mounted to the upper inboard surface of link 18, shaped and contoured to insert into slot 91 as the lift rises to its vertical, stowed position (as shown in dashed lines) from the transfer level position (shown in solid lines in FIG. 11B). This movement is indicated by Arrows $S_2$.

Note that although the preferred embodiment is shown with the pivot assembly mounted below the gate adjacent floor level and with the stanchion end portion oriented downwards, the principle of the invention may be embodied in a gate assembly in which the stanchion is oriented upwards to a pivot assembly mounted above the gate, such as to a vehicle ceiling structure. The cam and follower of such a ceiling mount system will function in the same manner as described above with respect to the principal embodiment. One of ordinary skill in the art will be able, without undue experimentation based on this disclosure and known art, to mount the bias spring 53 and interlock switch 62, if either is included, so as to function as described above.

Industrial Applicability:

It is clear that the pivoting barrier of the invention is a useful safety device for vehicle lift threshold use, providing a conveniently operated and secure protection against the hazard of a wheelchair inadvertently rolling out of the doorway when the lift platform is not at the transfer level, yet offering provision for manual passage. The safety interlock switch is also of self-evident commercial interest.

It should be understood that various modifications within the scope of this invention can be made by one of ordinary skill in the art without departing from the spirit thereof.

For example, alternative embodiments are feasible whereby the barrier of the invention is mounted on the wheelchair platform to prevent tip-forward of wheelchairs in the event of a runaway wheelchair event. In an installation adjacent the outboard end of the platform, the bottom of the stanchion section may include a foot plate extending below the bottom of the platform lip so that as the platform descends to ground level, just before it touches ground, the foot plate touches first, causing the stanchion to reciprocate upwardly within the sleeve and the pin follower follows the internal cam groove rotating the safety barrier from the transverse barrier position 90° to the open position. It acts automatically and entirely mechanically. It is thus a simple, trouble-free mechanism.

In other embodiments, the barrier of this invention can be provided in any passageway, entrance or other situation where a pivoting barrier could be used. The inventive barriers can either be totally manually actuated, or power actuated, either electrically, hydraulically or through other power linkage. In an important alternative embodiment, the rotational motion can be imparted by a variety of mechanical devices, including linkage to outboard barrier lifting chains or cables, gas lift units, linear actuators, gear drives or hydraulic mechanisms of conventional types. The gate members, while described above as selectively opening inwardly into the interior of the vehicle, could be oriented to open outwardly, so that the opposed P-shaped loop sections of each gate member do not take up room inside the vehicle during entry/exit through the passageway; in this embodiment, the gate sections positively lock in the closed position, so that a runaway or drifting wheelchair or wheelchair/occupant do not push the safety gate of the invention open.

As is conventional in this art, the lift and gate mechanisms have overrides in the event of electrical, mechanical and/or hydraulic failures. Thus, for example, the P loop portion of the gate 32 can be a part separate from but connected to the stanchion 37, e.g., by telescopingly interfitting the upper end of stanchion 37 into the lower end of the gate leg 33, with a safety release pin through aligned holes in both tubes. In the event of power failure, the powered version of the safety gate of the invention could become locked in the closed position (or the open-out position for that embodiment) preventing egress from the vehicle or door closure, as the case may be. Upon pulling the release pin, the P loop can be slipped upwardly off the stanchion and egress and door closure restored.

Therefore this invention is to be defined by the scope of the appended claims as broadly as the prior art will permit, and in view of the specification if need be.

What is claimed is:

1. A safety gate for a vehicle-mounted wheelchair lift, said lift having a lifting mechanism mounted to said vehicle in association with a doorway of said vehicle, said doorway having a first and a second side, and said lift having a platform movable between a lowered level and a transfer level at said doorway adjacent the vehicle floor inboard of said platform, said platform at said transfer level in association with said doorway defining a vehicle entry/exit passageway having a generally horizontal central axis, said safety gate comprising in operative combination:

a) a gate assembly including at least one gate member mountable in association with said doorway to be movable between a first, closed barrier position generally transverse to said passageway axis to a second, open position generally parallel to said passageway axis;

b) said gate assembly includes a stop mechanism to selectively permit said gate member to be opened inwardly into the interior of said vehicle, and to prevent opening said gate member outwardly toward said lift platform; and c) said gate member includes at least one barrier arm member positioned in said barrier position at an elevation above said vehicle floor a height between about ankle height to knee height relative to an occupant in a wheelchair positioned on said vehicle floor adjacent said doorway to provide a safety barrier against accidental roll-out of said wheelchair and occupant when said lift platform is away from said transfer level.

2. Safety gate as in claim 1 which includes a pair of said gate members, one of each of said pair positioned at each side of said doorway in spaced, generally coplanar relationship.

3. Safety gate as in claim 2 wherein said gate assembly includes a spring to bias said gate member toward said closed position.

4. Safety gate as in claim 1 wherein said gate assembly includes a controlled-force pivot assembly which applies to said gate member at least one of:

i) a stabilizing force when said gate is closed tending to keep said gate member closed;

ii) a restoring force as said gate member is between said open position and said closed position tending to return said gate member to said closed position; and iii) a stabilizing force when said gate member is in said open position tending to keep said gate member open.

5. A safety gate as in claim 2 wherein each said gate member includes a stanchion oriented to pivot around a generally vertical pivot axis, said gate assembly includes a mounting assembly in which said stanchion is journaled for pivotal movement, and said gate member comprises a plurality of arm and connector members, including said barrier arm member, connected generally in the form of a P, said gate members being oriented with the stanchions adjacent the doorway and the loop of the P of each facing the loop of the P of the other, in a pq relationship when closed to provide said safety barrier.

6. The safety gate as in claim 2 wherein said gate assembly includes a gate raising mechanism to cause said gate member to rise generally vertically as said gate member is moved away from said barrier position to produce a stabilizing gravitational restoring force tending to return said gate member to said barrier position.

7. The safety gate as in claim 6 wherein said gate raising mechanism includes a cam-and-follower mechanism supporting said gate member, and said cam is configured so as to cause said gate member to rise as said gate member is moved away from the barrier position to produce said stabilizing gravitational restoring force.

8. A safety gate as in claim 7 wherein:

a) said gate member includes a stanchion oriented to pivot around a generally vertical pivot axis; and b) said cam-and-follower mechanism includes a sleeve in which said stanchion is journaled, said sleeve includes a curved cam slot, said stanchion includes a follower pin member disposed in said cam slot, said cam slot and follower pin being oriented to raise said gate member as the gate member rotates from said barrier to said open position.

9. A safety gate as in claim 8 wherein said slot includes a portion intermediate the ends of said slot which is higher than either end to provide a stabilized rest position adjacent each end of said slot corresponding, respectively, to the safety gate closed and open positions.

10. A safety gate as in claim 1 wherein said gate assembly includes a safety interlock mechanism linked to said gate member to selectively prevent said gate member from being opened when said lift platform is away from said transfer level.

11. A method of preventing accidental roll-out of a wheelchair and occupant from a transfer level vehicle doorway associated with a vehicle-mounted wheelchair lift platform when said lift platform is away from said transfer level, said doorway having a first and a second side, and said lift having a platform movable between a lowered level and a transfer level at said doorway adjacent the vehicle floor inboard of said platform, said platform at said transfer level in association with said doorway defining a vehicle entry/exit passageway having a generally horizontal central axis, said method comprising the following steps in operative order:

a) moving at least one gate member mounted in association with said doorway between a first, barrier position generally transverse to said passageway axis to a second, open position generally parallel to said passageway axis;

b) limiting said gate member movement to selectively permit said gate member to be opened inwardly into the interior of said vehicle, and to prevent opening said gate member outwardly toward said lift platform; and c) said gate member moving step includes positioning at least a portion of said gate member in said barrier position at an elevation above said vehicle floor a height between about ankle height to knee height relative to an occupant in a wheelchair positioned on said vehicle floor adjacent said doorway to provide a safety barrier against accidental roll-out of said wheelchair and occupant when said lift platform is away from said transfer level.

12. The method of preventing accidental roll-out as in claim 11 further including the step of automatically preventing movement of said lift platform when said gate member is moved away from said barrier position.

* * * * *